US007185762B2

(12) United States Patent
Ferris

(10) Patent No.: US 7,185,762 B2
(45) Date of Patent: Mar. 6, 2007

(54) PRODUCT DISPLAY BAG

(76) Inventor: Neal Patrick Ferris, 10401 Breamore Dr., Charlotte, NC (US) 28270

( * ) Notice: Subject to any disclaimer, the term of this patent is extended or adjusted under 35 U.S.C. 154(b) by 394 days.

(21) Appl. No.: 10/809,113

(22) Filed: Mar. 25, 2004

(65) Prior Publication Data

US 2005/0211601 A1 Sep. 29, 2005

(51) Int. Cl.

| | |
|---|---|
| ***B65D 85/00*** | (2006.01) |
| ***B65D 23/12*** | (2006.01) |
| ***B65D 33/16*** | (2006.01) |
| ***B65D 53/00*** | (2006.01) |

(52) U.S. Cl. ..... 206/525; 206/815; 206/731; 220/756; 383/66; 383/7

(58) Field of Classification Search ..... 206/160, 206/166, 815, 730, 731; 383/6, 7, 10, 17, 383/21, 66 X, 66; 220/254.1, 756 X, 770, 220/776

See application file for complete search history.

(56) References Cited

U.S. PATENT DOCUMENTS

| | | | | |
|---|---|---|---|---|
| 2,745,754 | A * | 5/1956 | Steinbock | 426/112 |
| 3,066,792 | A | 12/1962 | Spilman et al. | |
| 3,160,341 | A | 12/1964 | Cherney | |
| 4,420,080 | A * | 12/1983 | Nakamura | 206/449 |
| 4,867,575 | A * | 9/1989 | Wood | 383/17 |
| 6,022,145 | A * | 2/2000 | Searfoss | 383/66 |
| 6,161,959 | A | 12/2000 | Abraham | |
| 6,217,215 | B1 * | 4/2001 | Tomic | 383/63 |
| 6,327,754 | B1 * | 12/2001 | Belmont et al. | 24/400 |
| 6,328,158 | B1 | 12/2001 | Bisbal et al. | |
| 6,478,219 | B1 | 11/2002 | Holley, Jr. | |

FOREIGN PATENT DOCUMENTS

FR 2692868 A1 * 12/1993

* cited by examiner

*Primary Examiner*—Jila M. Mohandesi
(74) *Attorney, Agent, or Firm*—McNair Law Firm PA

(57) ABSTRACT

A flexible package for displaying, accessing and transporting dry goods which includes an upper member, a lower member and four side members inter-engaged along adjacent edges forming an inner area. An opening is formed in one of the forming members allowing access to the inner area of the package. A flexible patch having a pair of generally parallel spaced openings forming a strip there between is secured to the one forming member with the strip positioned over and covering the opening. The package is constructed to display the goods stored in the inner area, to allow access to the inner area through the opening for ascertaining the texture of the goods and to provide ease of transport by utilization of the strip as a carrying handle.

21 Claims, 2 Drawing Sheets

PRODUCT DISPLAY BAG

BACKGROUND OF THE INVENTION

The instant invention is related to packaging for storage, display and transport of goods, which includes transparent and non-transparent forming material, a handle and a touch arrangement. The touch arrangement functions to assist in the display of the packaged merchandise and the handle arrangement assists in transport of the package and packaged goods.

Reclosable and transparent packaging is well known as is illustrated by U.S. Pat. Nos. 6,161,959 and 6,328,158. These and most others now on the market provide see-through packages for displaying the packaged goods provided with a zipper operable to open the package allowing removal of the goods for use and closure of the package for storage of the goods when not in use.

It has been found that customers, many times, also desire to know the texture of the goods along with the displayed color and design. To this end, the zipper is currently being released allowing the top of the packaging to be lifted exposing the goods to the surrounding elements such as dirty floors, etc. Often times the zipper is not re-closed, or sometimes, the goods are caught in the zipper during attempted re-closing, or sometimes the goods are partially removed from the package and not returned. None of these occurrences are desirable as they may lead to soiled or damaged goods and an unacceptable presentation of goods. It is, however, desirable that the customer be allowed to feel the texture of the product.

It is, therefore, a primary object of this invention to provide packaging which allows customer access to the packaged goods without opening the package.

Another object of the present invention is structure which both allows access to the packaged goods and protects the packaged goods for outside exposure.

Another object of the invention is the provision of packaging which provides for ease of transport.

Another object of the invention is packaging which is re-closable, allows visual access to the goods, allows physical access to the goods without opening the package and is easily transported.

SUMMARY OF THE INVENTION

The instant invention is directed to reusable packaging which preferably but not necessarily consists of a clear vinyl bag or package capable of displaying and transporting the packaged goods and which includes access to the packaged goods without opening the bag or package. The containment or bag comprises upper and lower surface members which are interconnected along each edge with a side member. The side members are interconnected along adjacent edges forming an enclosed inner area for receiving the goods. A re-engageable closure member which is located between selected of the side members and one of the upper and lower surface members is provided. The closure member provides with a reclosable opening which provides the bag with in and out access. A patch is attached to one of the upper, lower and side members. The patch comprises a vinyl piece having a pair of spaced elongated openings arranged adjacent opposed edges of the patch forming an elongated strip there between. Securing members, which are located adjacent and along each edge of the patch, secure the patch with said the bag.

An opening is formed in an outer surface of the containment or bag beneath the patch and is covered by the strip. The opening provides access to the goods by simply shifting or moving the strip which uncovers the opening. The strip also functions as a handle which accommodates transport of the bag.

The upper, lower and side members of the containment are preferably formed of a lightweight vinyl while the patch is formed of a heavy grade vinyl. The patch may be secured with the bag by heat sealing, glue or stitching. The re-engageable closure member may be a zipper or it may be some form pressure seal.

A package for accessing, transporting and displaying dry goods which includes an upper member, a lower member and four side members inter-engaged along adjacent edges forming an inner area. The package is preferably formed of flexible clear vinyl however other suitable flexible materials such as textile fabrics or colored plastic sheeting may also be acceptable.

There is an opening formed in one of the members allowing access to the inner area. A flexible patch forming a strip is secured along at least two edges to the package in position to provide a strip positioned over covering the opening and forming a carrying handle for transport of the package.

The package is functionable to display the goods in an enclosed condition, to allow access through the opening to ascertain the texture of the goods and to allow ease of transport by utilizing the strip as a carrying handle.

The patch is generally rectangular and is secured with the package adjacent at least two outer edges with a heat seal, stitching or other suitable means. Other patch shapes such as oval, triangular, square, etc. are also acceptable.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
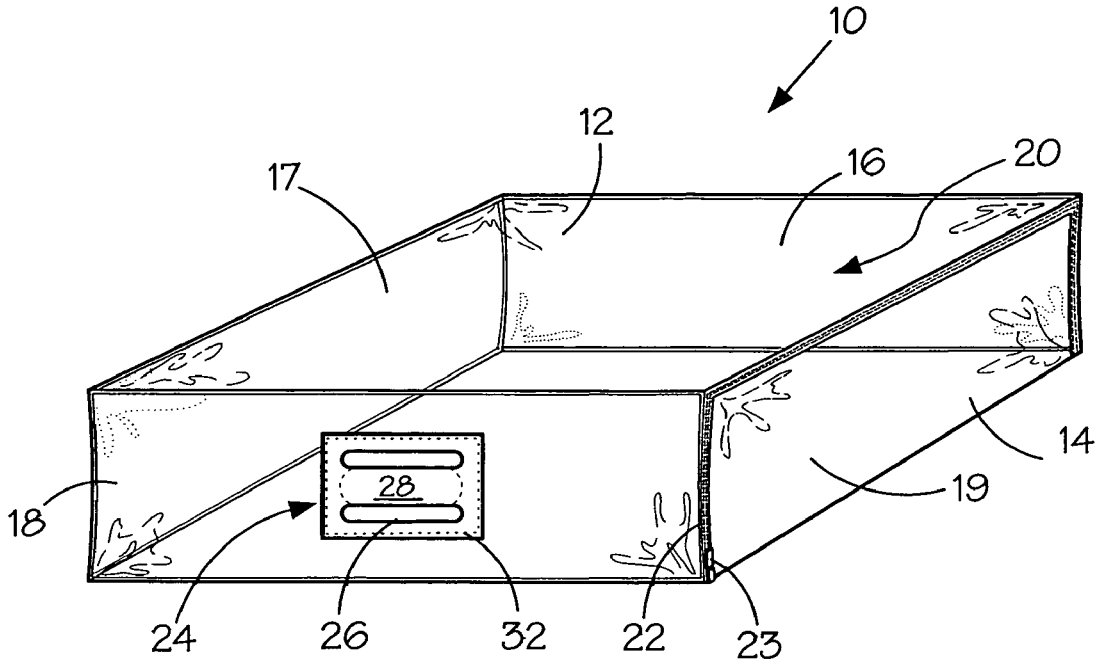
FIG. 1 is a perspective view of a flexible re-closable package in which the touch-handle arrangement of the invention has been incorporated.

Turning now to FIG. 1, package 10 which as shown represents one of several types of packages thought to be most beneficial for use with the instant invention. Package 10 is constructed of a clear and flexible vinyl, preferably PVC, so as to allow the packaged product to be seen and to allow ease of transport and storage. Package 10 includes an upper surface 12 and a lower surface 14 which are interconnected along each edge with side members 16, 17, 18 and 19. The outer edges of lower surface 14 are connected with lower edges of sides 16, 17 and 18 by stitching or heat sealing. Three edges of upper surface 12 are similarly connected with upper edges of side members 16, 17 and 18. Adjacent edges of side members 16, 17 and 18 are also similarly connected.

A reclosable or re-engageable closure 22 which may be a zipper or a pressure sealing member, is connected along the adjacent edges of sides 16, 18 and 19 and the adjacent edges of upper surface 12 and side 19. Re-engageable closure 22, which includes a slidable closure member 23, provides access into interior 20 of package 10 and also closure or sealing of the package for encasing goods. The structure thus far described is old to the industry. The instant invention is an improvement to this and other similar structures.

The package so far described provides for visual display of the goods, generally bedding or some other form of dry goods. The package is operative securely seals the goods therein protecting them from soiling while providing a visual display of the goods.

The package as so far described is somewhat cumbersome for transport. The package does not easily provide access to the packaged goods allowing the customer the ability to feel the goods to determine its texture without activating the reclosable closure which sometimes produces merchandising problems.

In order to remove the drawbacks, the instant invention is adapted to packages of the type so far described.

A patch 24 which is normally formed of a heavy gauge clear vinyl, preferably PVC, however, any suitable other material could be employed such as colored plastics or textile fabrics. Patch 24 is formed preferably with a pair of elongated and parallel cutouts 26 which are arranged along a pair of opposed edges. Cutouts 26 produce a strip 28 therebetween which extends between the remaining opposed edges. The patch is preferably formed to be about 5.5 inches in a first direction and 4 inches in the opposite direction. The cutouts are about 4 inches long and extend parallel with the long side of the patch. The strip is about 1.5 inches in width and about 4 inches in length. It is noted that the size and shape of the patch along with that of the cutouts and strip may vary so long as the patch provides structure functionable in the manner to be described. For example, the patch could be oval shaped and the cutouts could be crescent shaped.

One of surface 12, 14 or a side 16, 17, 18 and 19 is selected for application of patch 24 thereto. An opening or orifice 30 is cut through a central area of the selected area. In FIG. 1, opening 30 is formed in side 18. Opening 30 is preferably slightly smaller than ship 28 both in length and width. Opening 30 could be circular or of any other desired shape, the only requirement is that the open area be covered by the ship. Patch 24 is preferably secured with side 18 with a heat seal 32 or with stitching in position with strip 28 being centrally located over opening 30 and cutouts generally aligned parallel with the opposed edges of side 18.

It is noted that patch 24 could simply comprise a rectangular piece of a width and length sufficient to cover opening 30. In this arrangement only two opposed ends of the patch would be secured with the package side in the above described manner positioning the patch over opening 30. The intermediate portion of the entire patch serves in this arrangement as the opening cover and the handle.

Figure 2A:
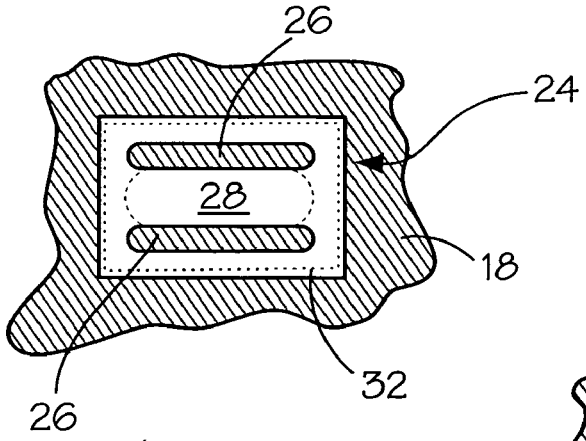
FIG. 2A is an exploded sectional top view of the touch-handle arrangement.
Figure 2B:
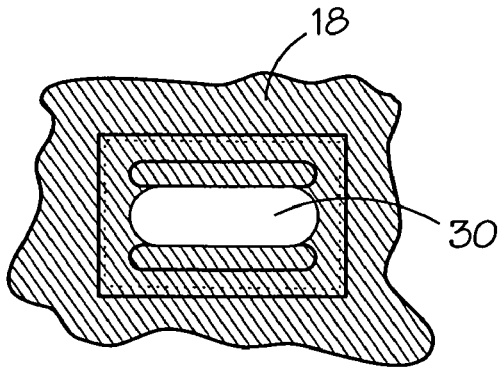
FIG. 2B is an exploded sectional bottom view of the touch-handle arrangement.

FIG. 2A shows, from the top, patch 24 secured to the outer surface of side 18 with strip 28 covering opening 30. FIG. 2B shows the same structure from inside the package.

Figure 3:
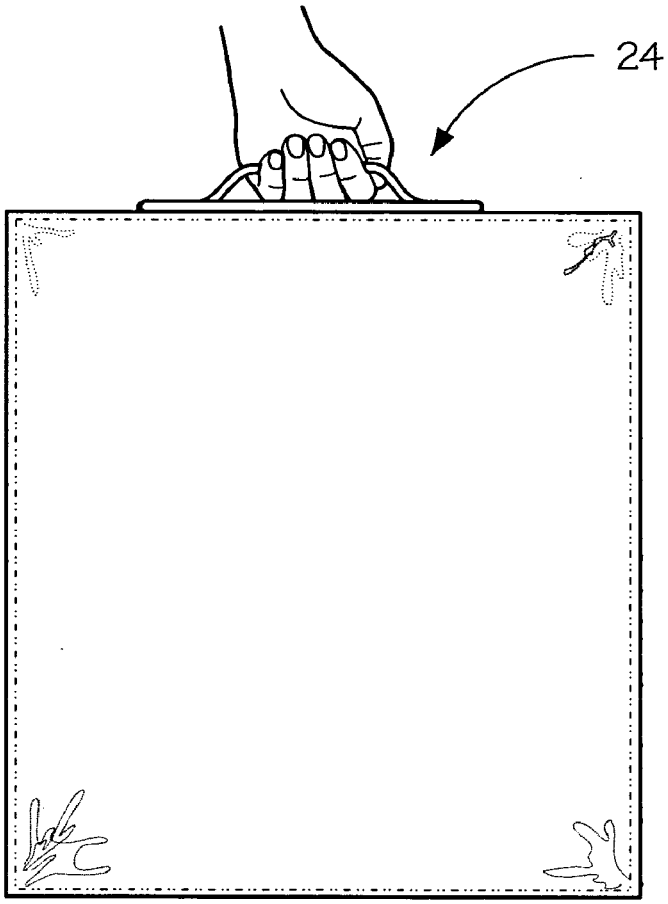
FIG. 3 is a diagramatic side view of the handle in use.

FIG. 3 is a schematic view showing strap 28 being utilized as a carrying handle for transporting the bag.

Figure 4:
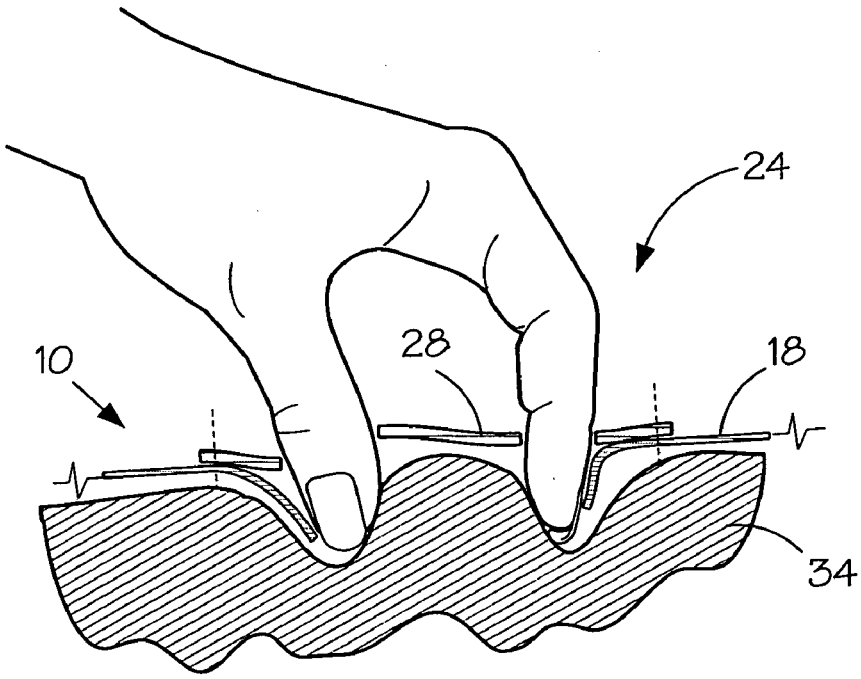
FIG. 4 is a sectional side view showing a relationship of the handle strap, the opening, the goods and a persons fingers when feeling the goods.

FIG. 4 shows a method in which a person may access dry goods 34 which are packaged in interior 20 of package 10 through opening 10. It is noted that when the hand is removed from the bag, strip 28 re-positions itself over opening 30 resealing interior 20 and protecting the goods packaged therein.

While a preferred embodiment of the invention has been described using specific terms, such description is for illustrative purposes only, and it is to be understood that changes and variations may be made without departing from the spirit or scope of the following claims.

What is claimed is:

1. A product display bag for packaging, displaying and transporting goods comprising;

upper and lower surface members interconnected along each edge by a side member, said side members being interconnected along adjacent edges forming an enclosed inner area for receiving said goods;

a re-engageabte closure member forming said connection between selected of said side members and one of said upper and lower surface members providing said bag with in and out access for said goods;

an orifice formed in said one of said upper, lower and side members;

a patch attached to said one of said upper, lower and side members, said patch comprising a vinyl piece having a pair of spaced elongated openings arranged adjacent opposed edges of said patch forming a strip there between;

securing means, boated adjacent and along each edge of said patch, securing said patch with said one of said upper, lower and side members with said strip positioned over said orifice; wherein, said strip forms a movable cover allowing access to said goods by shifting said strip away from said orifice and a transport handle for said bag by elevating said strip.

2. The bag of claim 1 wherein said upper, lower end side members are formed of a lightweight vinyl and said handle member is formed of a heavy grade vinyl.

3. The bag of claim 1 wherein said securing means comprises heat sealing.

4. The bag of claim 1 wherein said securing means comprises glue.

5. The bag of claim 1 wherein said securing means comprises stitching.

6. The bag of claim 1 wherein said re-engageable closure member is a zipper.

7. The bag of claim 1 wherein said re-engageable closure member is a pressure seal closure.

8. A package for accessing, transporting and displaying dry goods, said package comprising:

an upper member, a lower member and four side members inter-engaged along adjacent edges forming an inner area for receiving said goods, said members being formed of flexible material;

an opening formed in one of said members allowing access to said inner area;

a flexible patch having a pair of elongate spaced openings forming a strip there between, said patch being secured to said one of said members with said strip positioned over and covering said opening: wherein, said package displays said goods in an enclosed inner area when said strip is unmoved, said package allows access to said goods through said opening when said strip is moved and said package is provided a carrying handle when said strip is gripped.

9. The package of claim 8 wherein said members are formed of clear vinyl.

10. The package of claim 8 wherein said patch is formed of clear vinyl.

11. The package of claim 8 wherein said upper member is engaged with three adjacent side members with a re-closable securing member.

12. The package of claim 8 wherein said opening and said patch are located centrally of one of said side members.

13. The package of claim 8 wherein said members and said patch are formed from the group consisting of polyolefins, polyesters, polyvinyl chlorides, papers, textile fabrics, individually and in combination thereof.

14. The package of claim 13 wherein said PVC forming said patch is of a heavier gauge than that forming said sides.

15. The package of claim 8 wherein said patch is generally rectangular.

16. The package of claim 8 wherein said patch is secured with said one member with a heat seal adjacent its outer edges.

17. The package of claim 8 wherein said patch is secured with said one member with stitching adjacent its outer edges.

18. The package of claim 8 wherein certain of said adjacent edges are secured by stitching.

19. The package of claim 8 wherein certain of said adjacent edges are secured with a heat seal.

20. A product packaging and display bag formed of flexible material comprising:

a re-sealable opening for in and out access of said product;

an orifice formed in one surface of said bag;

a patch attached to said one surface and including an elongated strip attached to said patch at its opposed ends and in position closing said orifice, said elongated strip attached in such a manner as to allow said elongated strip to be moved away from said orifice to form a carrying handle and or to allow finger access to said product, and said elongated strip being returnable to said position to cover and re-close said orifice.

21. The product packaging and display bag of claim 20 wherein said flexible material is transparent.

* * * * *